US005694643A

United States Patent [19]

Fujiwara

[11] Patent Number: 5,694,643

[45] Date of Patent: Dec. 9, 1997

[54] BODY DRYING CLOTHING ARTICLE

[76] Inventor: Tomoko Fujiwara, 4-49 Koryo-cho, Kita-ku, Kobe-shi, Hyogo, Japan

[21] Appl. No.: 459,997

[22] Filed: Jun. 2, 1995

[30] Foreign Application Priority Data

Jun. 8, 1994 [JP] Japan ..... 6-126158

[51] Int. Cl.[6] ..... A41D 3/00; A41D 10/00; A41D 15/00

[52] U.S. Cl. ..... 2/69; 2/83; 2/86; 2/114; 2/109

[58] Field of Search ..... 2/69, 69.5, 75, 2/80, 83, 86, 114, 104, 109

[56] References Cited

U.S. PATENT DOCUMENTS

| | | | |
|---|---|---|---|
| 735,668 | 8/1903 | Heitmann | 2/69 |
| 1,394,213 | 10/1921 | Ohrenstein | 2/80 |
| 1,435,147 | 11/1922 | Burns | 2/80 |
| 1,876,282 | 9/1932 | Ellerbeck et al. . | |
| 2,018,782 | 10/1935 | Gephart . | |
| 2,058,509 | 10/1936 | Rose | 2/69 X |
| 2,511,977 | 6/1950 | Garrison | 2/83 X |
| 2,876,455 | 3/1959 | Harmon | 2/80 |
| 2,989,753 | 6/1961 | Burner | 2/69.5 |
| 3,548,213 | 12/1970 | Mason | 2/80 |
| 3,987,505 | 10/1976 | Hickey | 2/114 |
| 4,172,300 | 10/1979 | Miller | 2/69.5 X |
| 4,597,121 | 7/1986 | Bouma | 2/69 X |
| 4,947,489 | 8/1990 | Greenwood | 2/80 X |
| 4,989,286 | 2/1991 | Tucker | 2/69.5 X |
| 5,033,121 | 7/1991 | Larson | 2/80 X |

*Primary Examiner*—C. D. Crowder
*Assistant Examiner*—Shirra L. Jenkins
*Attorney, Agent, or Firm*—Lowe, Price, LeBlanc & Becker

[57] ABSTRACT

Clothes such as a bathrobe having superior moisture absorption and thermal insulation and which keeps one's body dry and clean as it absorbs water remaining not only on the upper half but also at the lower half of one's body after bathing or the like and keeps one's body warm, is provided. The bathrobe includes a body part and an attached cloth. The attached cloth is attached to the body part of the bathrobe to cover one's crotch. A band is attached on one end of the attached cloth.

7 Claims, 14 Drawing Sheets

BODY DRYING CLOTHING ARTICLE

BACKGROUND OF THE INVENTION

1. Field of the Invention

The present invention relates to clothes such as a bathrobe, a kimono robe or the like, which is slipped over one's wet body.

2. Description of the Background Art

A conventional bathrobe is for putting on a wet body after a person takes a shower or bath, or put on a wet body at the pool side or beach. The bathrobe is put directly on one's wet body so that the cloth of the bathrobe absorbs the water or moisture of one's body, and its serves to keep one's body warm.

However, as the bathrobe is something like a long coat slipped over one's body, when a person wears the robe, it is mainly in contact with the upper half of the person, especially with his or her shoulders and back. Accordingly, water on the upper half of the body is absorbed by the cloth of the bathrobe, while water adhered on the lower half of the body may not be absorbed by the cloth of the bathrobe and left on the body. As a result, even when a person wears the bathrobe, water or moisture left on the lower half of the body is not absorbed, which is not comfortable, and in addition, the body may be cooled by the remaining water.

Further, when a person puts himself or herself at ease wearing a bathrobe, it may possible that water left on the lower half of his or her lower body drops down, wetting floor.

SUMMARY OF THE INVENTION

Therefore, an object of the present invention is to provide clothes such as a bathrobe which absorbs water or moisture left not only on the upper half but also on the lower half of one's body, which is highly hygroscopic and thermally insulating so as to keep one's body warm, which helps drying and keeping one's body clean.

The clothes of the present invention is for putting directly on one's wet body, and it includes a body part or panel and an attached cloth attached to the body part for wrapping and enclosing one's crotch.

The cloth of the body part of the clothes absorbs water adhered on the upper half of one's body, and water adhered on one's crotch is absorbed by the attached cloth covering one's crotch. Therefore, the person wearing robe can keep his or her body warm, not cooled by the water which may otherwise left unabsorbed and left on parts of his or her body, and the skin is dried comfortably. Thus the clothes exhibits satisfactory moisture absorption and thermal insulation.

In a preferred embodiment, the attached cloth may be sewn on the body part of the clothes, so that the body part and the attached cloth can be integrated. Therefore, the clothes is convenient and expected to be used frequently, as it can avoid the trouble of wearing a number of garments.

In a more preferred embodiment, the attached cloth can be attached on and detached from the body part of the clothes, and therefore the cloth can be put on the body part of the clothes only when drying or absorption of water at the crotch is necessary. Further, the cloth can be detached and washed separately from the body part.

According to another preferred embodiment, the attached cloth includes a strip shaped cloth, and at one end of the cloth, a band is provided. Accordingly, the attached cloth may serve as a loincloth, so that the strip shaped cloth can be passed from one's back through the crotch and the crotch can be wrapped by the strip shaped cloth. Accordingly, one's back, buttocks, crotch and abdomen can be covered by the cloth. Since a band is provided on one end of the strip shaped cloth, the cloth arranged as described above can be secured by the band. In this manner, water on the overall waist portion of one's body can be absorbed, and the clothes can exhibit higher moisture absorption and thermal insulation. At the same time, good air permeability at one's crotch is ensured, and the crotch can be kept clean and comfortable.

In a preferred embodiment, the band includes an elastic body. Accordingly, when the attached cloth is secured at the crotch by using the band, the attached cloth closely fits one's body, and it is comfortable to wear.

In a further preferred embodiment, an intermediate portion of the band including an elastic body is attached to one end of the strip shaped cloth, and mutually engageable fittings are provided at opposing ends of the band. Accordingly, the attached cloth can be secured at one's crotch at one touch by the fittings. Therefore, it can be more closely fit one's body, and provides better appearance. This embodiment is especially suitable for women.

In a preferred embodiment, the attached cloth includes a strip shaped cloth, which includes a relatively wide one end and a relatively narrow the other end, with said one end attached to the body part of the clothes. Therefore, the area covering the buttocks and side portions of one's body of the relatively wide one end is increased. In this manner, water on the overall waist portion is absorbed, and moisture absorption and thermal insulation can further be improved.

According to a more preferred embodiment, mutually engageable fittings are attached to a peripheral edge of the relatively wide one end of the cloth. Therefore, the attached cloth can be secured around the overall waist portion at one touch, and it can be more closely fit on the body when the person wearing the clothes moves around.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
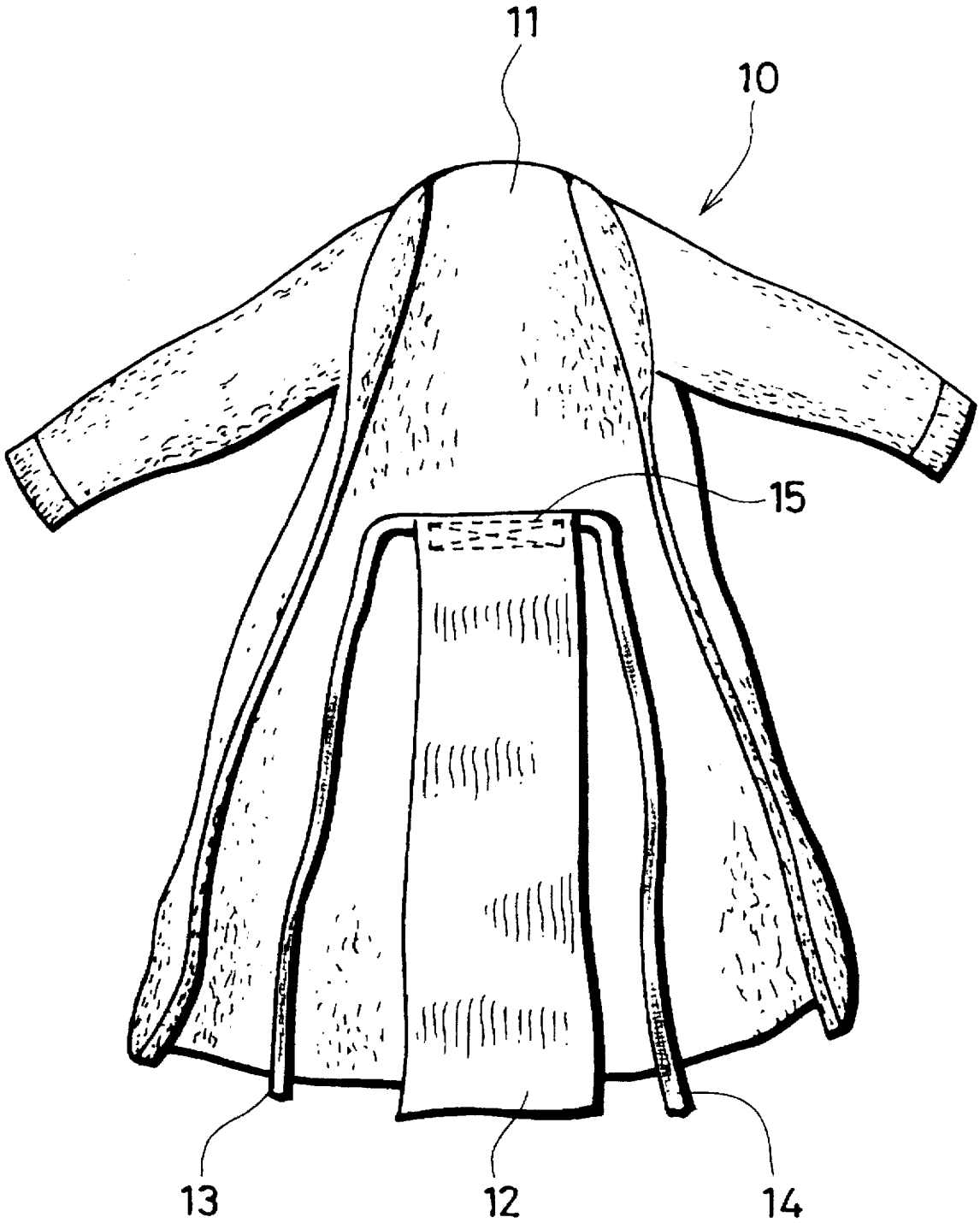
FIG. 1 shows a bathrobe in accordance with a first embodiment of the present invention.

FIG. 1 shows the first embodiment of the clothes of the present invention.

Referring to FIG. 1, a bathrobe 10 includes a body part 11 and an attached cloth 12. The attached cloth 12 is provided at a position corresponding to one's crotch, and sewn on body part 11 at an attaching portion 15. Bands or laces 13 and 14 are provided at one end of attached cloth 12. Attached cloth 12 is formed of a strip shaped longitudinal cloth extending downward from body part 11 of bathrobe 10.

Figure 2:
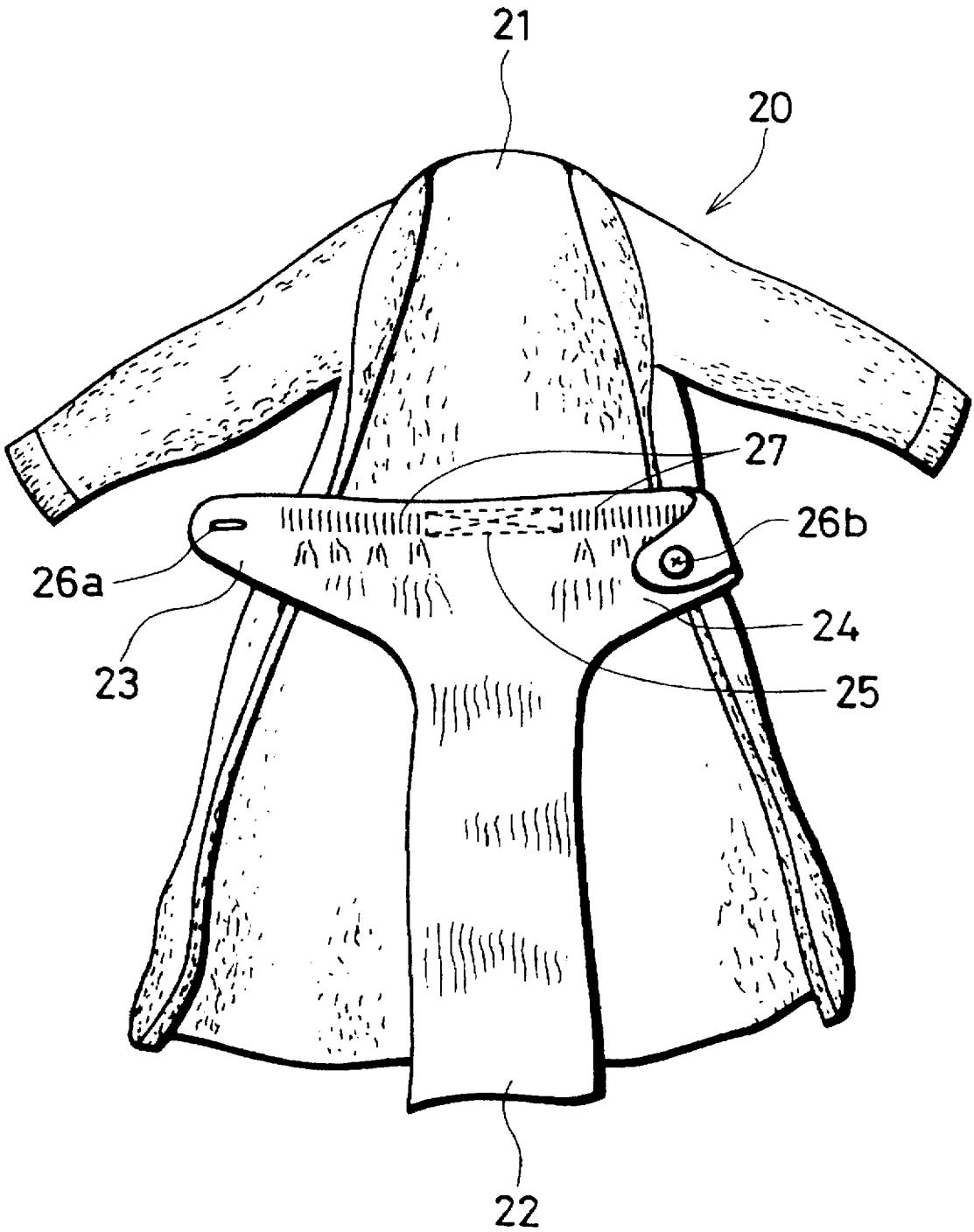
FIG. 2 shows a bathrobe in accordance with a second embodiment of the present invention.

FIG. 2 shows the second embodiment of the clothes in accordance with the present invention.

Referring to FIG. 2, a bathrobe 20 includes a body part 21 and an attached cloth 22. Attached cloth 22 is provided at a position corresponding to one's crotch, and sewn on body part 21 at an attaching portion 25. One end of the attached cloth 22 is made relatively wider. Along the edge of the widened portion, a rubber band 27 is provided. At a portion 23 of the widened portion, a button hole 26 is opened, and at the other portion 24, a button 26*b* is attached. The other end of attached cloth 22 is formed of a strip shaped longitudinal cloth extending downward from body part 21 of bathrobe 20.

Figure 3:
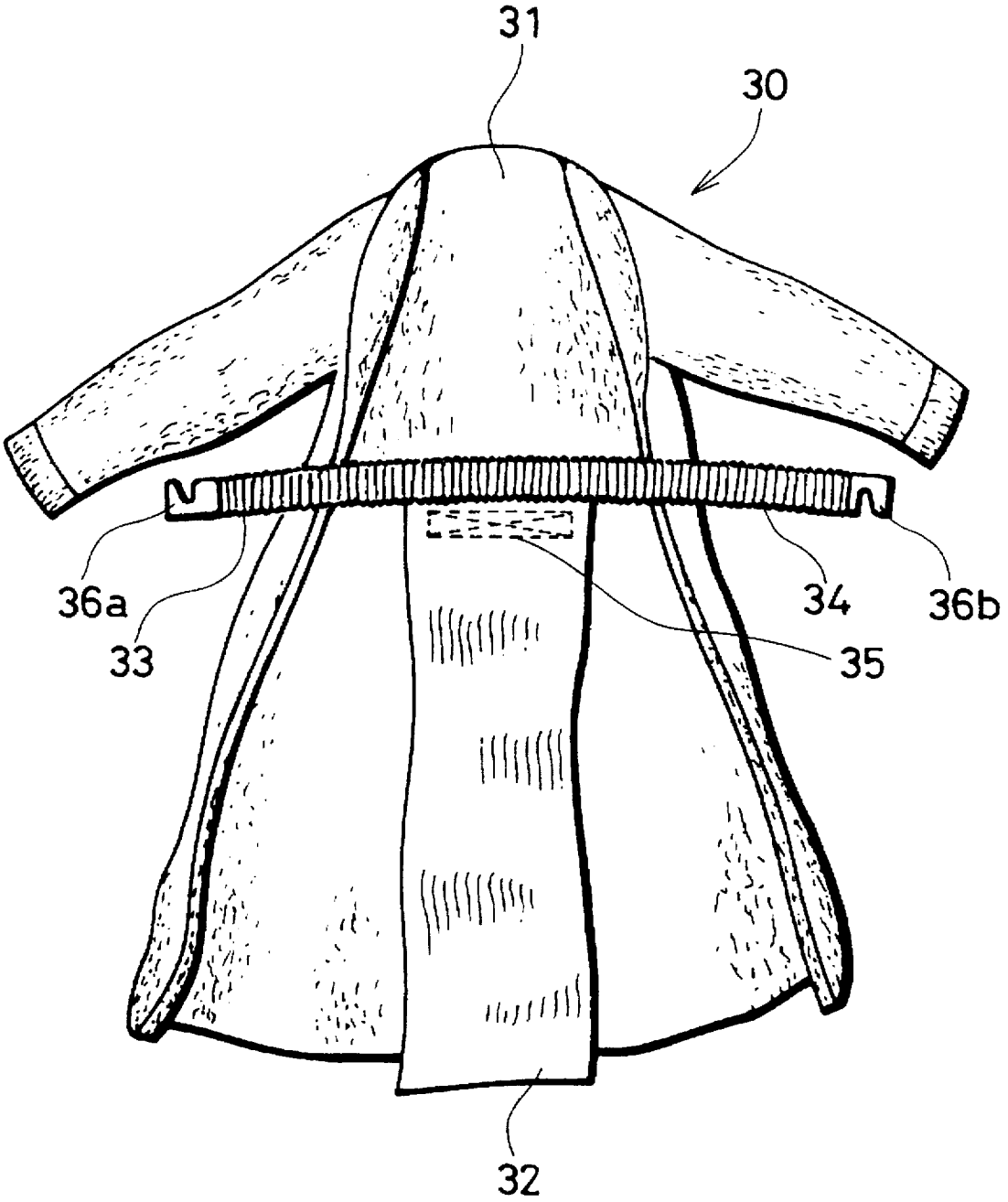
FIG. 3 shows a bathrobe in accordance with a third embodiment of the present invention.

FIG. 3 shows the third embodiment of the clothes of the present invention.

Referring to FIG. 3, a bathrobe 30 includes a body part 31 and an attached cloth 32. The attached cloth 32 is provided at a position corresponding to one's crotch, and sewn on body part 31 at an attaching portion 35. At one end of the attached cloth, wide bands (or cloth) 33, 34 in which rubber is inserted, are attached. At one end 33 of the band, a fitting 36*a* is provided, and at the other end 34, a fitting 36*b* is provided. Fittings 36*a* and 36*b* are mutually engageable. The other end of attached cloth 32 is formed of a strip shaped longitudinal cloth 5 extending downward from body part 31 of bathrobe 30.

Figure 4:
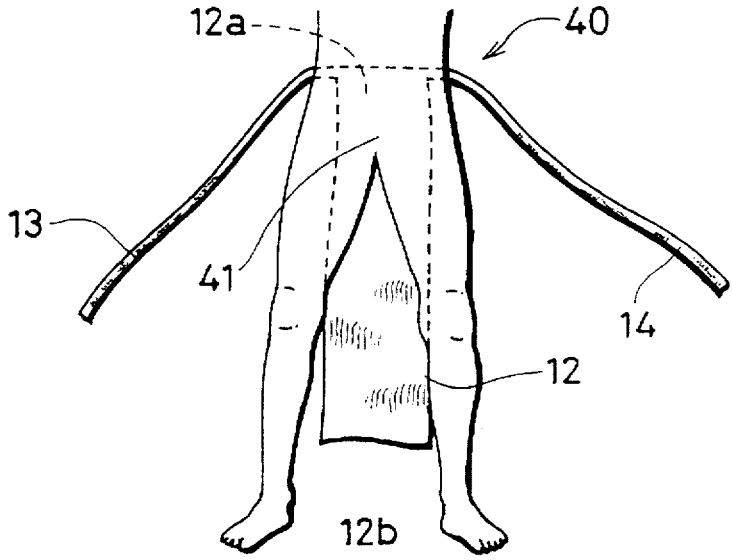
FIG. 4 is first illustration showing a method of wearing the attached cloth in an embodiment of the present invention.
Figure 5A:
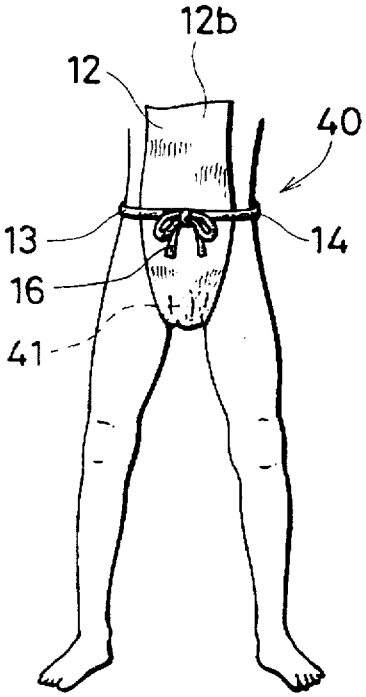
FIGS. 5A, 5B and 5C are second illustration showing the method of wearing the attached cloth in an embodiment of the present invention.
Figure 5B:
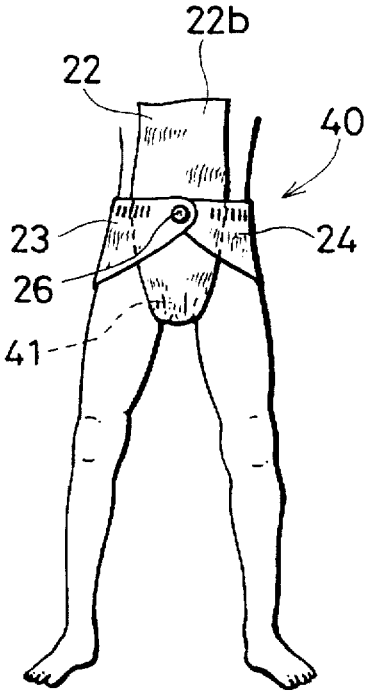
Figure 5C:
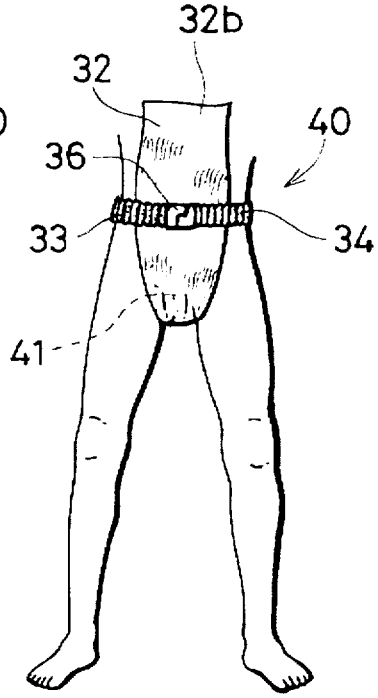
Figure 6:
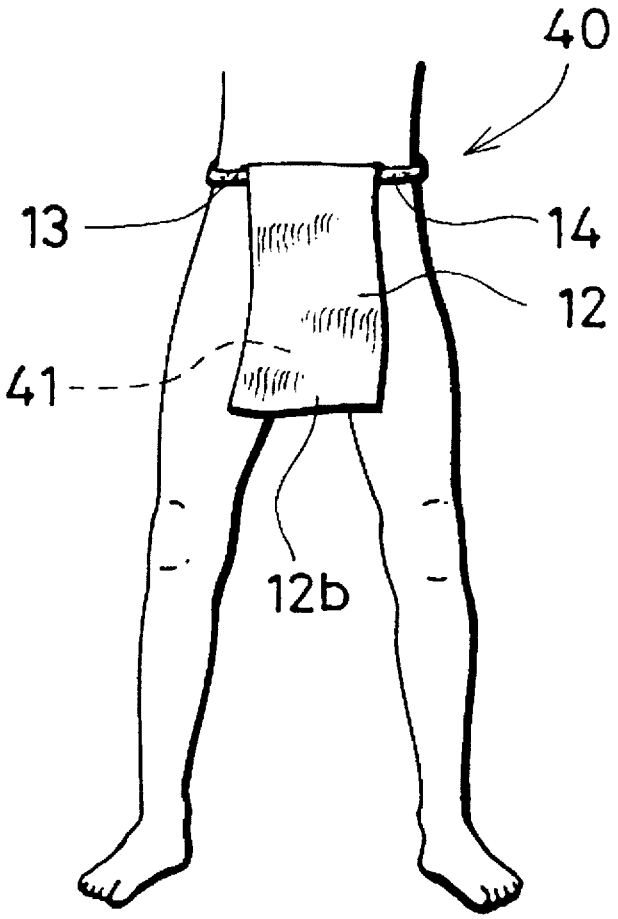
FIG. 6 is third illustration showing the method of wearing the attached cloth in an embodiment of the present invention.

FIGS. 4 to 6 show, in order, the method of wearing the clothes, focusing only on the attached cloth 12 (or 22, 32).

First, referring to FIG. 4, in the first embodiment, one end 12*a* of attached cloth 12, that is, the end provided with laces 13, 14 is put on the waist of one's body 40. At this state, attached cloth 12 is positioned so as to extend downward from the back side of crotch 41, that is, from the buttocks of body 40. This is the same in the second and third embodiments.

Referring to FIG. 5A, in the first embodiment, the other end (which is not provided with the laces 13, 14) 12*b* of attached cloth 12 is put from the buttocks through the crotch to the front of the crotch 41 of one's body 40, so that the crotch 41 and the buttocks are covered by attached cloth 12. With the other end 12*b* of attached cloth 12 pulled upward, laces 13 and 14 are tied on attached cloth 12. Thus the knot 16 of laces 13 and 14 is positioned on the attached cloth 12. The attached cloth 12 is secured by the tied laces 13 and 14.

Referring to FIG. 5B, in the second embodiment, the other end (narrow end) 22*b* of attached cloths 22 is passed from the buttocks through the crotch to the front side of crotch 41 of one's body 40, and crotch 41 and buttocks are covered by attached cloth 22. With the other end 22*b* of attached cloth 22 pulled upward, one and the other end portions 23 and 24 which are wide and provided with rubber are positioned on attached cloth 22, and button 26*b* is engaged in button hole 26*a*. In this manner, engaging portion 26 is positioned on attached cloth 22. The attached cloth 22 is secured by engaging portion 26 such that the cloth covers the crotch 41 of one's body 40 and the wide portions 23 and 24 cover and wrap the waist portion of one's body 40.

Referring to FIG. 5C, in the third embodiment, the other end (not provided with the wide band with rubber or cloth 33, 34) 32*b* of attached cloth 32 is passed from the buttocks through the crotch to be positioned in front of the crotch 41 of one's body, and the crotch 41 and buttocks are covered by the attached cloth 32. With the other end 32*b* of attached cloth 32 pulled upward, bands 33 and 34 in which rubber is inserted is pulled to be in close contact with one's waist portion of the body 40, and the bands are positioned on attached cloth 32. The fittings 36*a* and 36*b* attached to the bands 33 and 34, respectively, are engaged on attached cloth 32. In this manner, the engaging portion 36 is positioned on the attached cloth 32. Bands 33 and 34 are closely fit at the waist portion of one's body, and attached cloth 32 is secured by the engaging portion 36 to cover the crotch 41 of one's body 40.

Referring to FIG. 6, in the first embodiment, the other end 12*b* of attached cloth 12 goes over the knot 16 and suspended outward. This is the same in the second and third embodiments.

Figure 7:
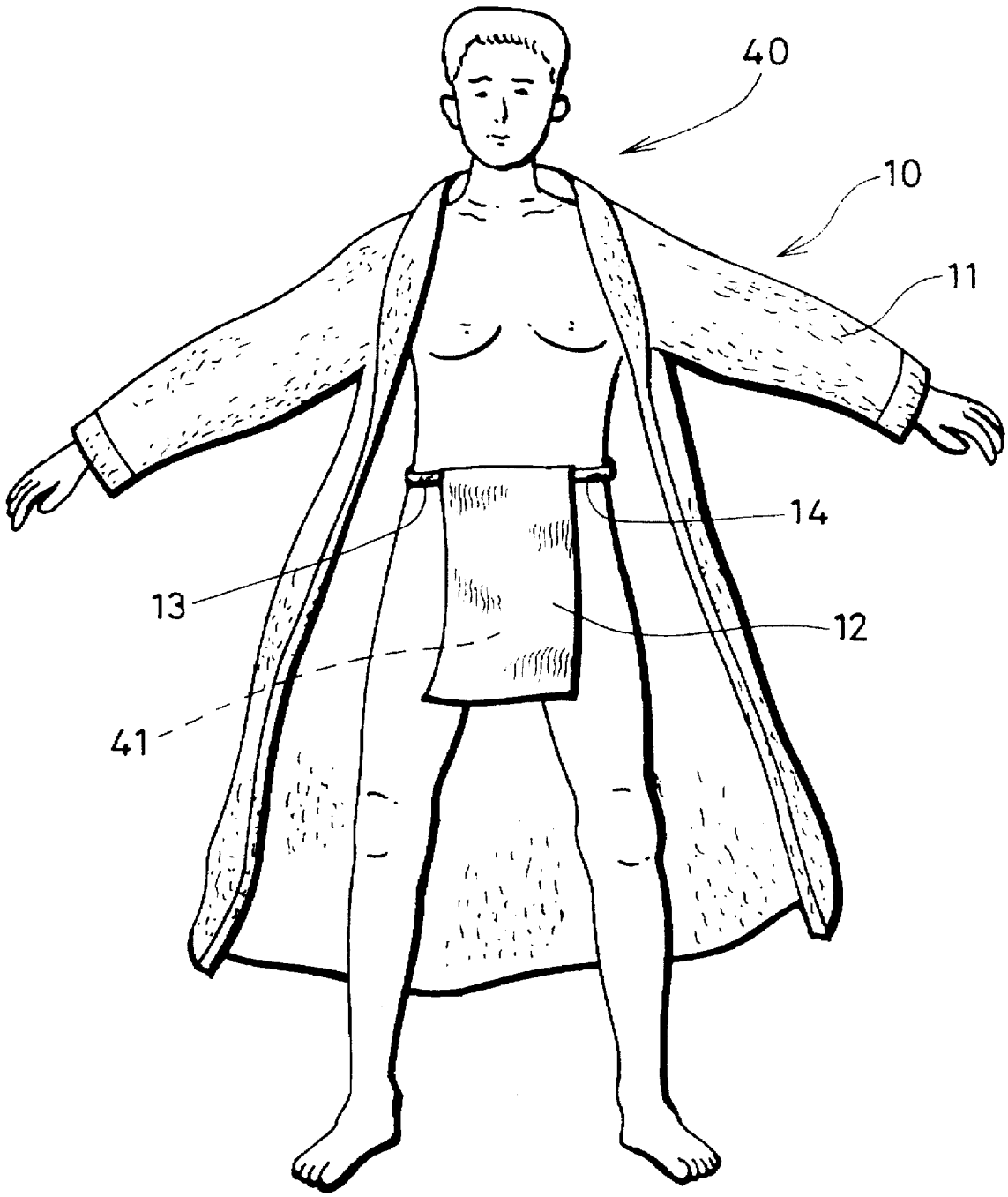
FIG. 7 shows a person wearing the bathrobe in accordance with the first embodiment of the present invention.

A person wearing attached cloth 12 in the above described manner is shown in FIG. 7. As is apparent from FIG. 7, water adhered on the upper half, that is shoulders or back of one's body 40 is absorbed by the lining cloth of body part 11 of bathrobe 10, while water adhered on the crotch 21 of one's body 20 is absorbed by attached cloth 12.

Preferably, the attached cloth 12 is formed of a soft, and not rough material such as toweling or gauze.

In the above embodiments, the attached cloth 12 is sewn on body part 11 at attaching portion 15. However, cloth 12 may be attached to and detached from body part 11 by using hooks, a button, a VELCRO®, e.g., a conventional hook and loop fastening tape system, (tape fastener) or the like.

In the second and third embodiments above, a button such as shown in FIG. 2 or fittings such as shown in FIG. 3 are used as fittings for securing the attached cloth 22 or 32. However, VELCRO®, e.g., a conventional hook and loop fastening tape system, or hooks may be used as the fitting. Though the present invention has been applied to the bathrobe in the above embodiments, it may be similarly applied to garments which are directly put on one's body, such as kimono robe or a negligee. The clothes of the present invention may be used by:

(1) a sick person, an aged or a baby, who needs help in bathing;

(2) a person who takes bath with the one mentioned in item (1) above, and helps clothing of the one just mentioned after bathing (for example, a mother);

(3) one who has difficulty to reach one's crotch (a pregnant woman, a woman just after child birth and not yet recovered her shape, one who is obese, an athlete of large frame such as a sumo wrestler, a judo expert, a wrestler or the like);

(4) one, who is not a handicap, and putting himself or herself at ease after swimming or bathing in sauna; and (5) an invalid confined to bed, who needs help to relieve himself or herself, or a sick person having difficulty in wearing underwear.

In one aspect, use of the cloth of the present invention takes into consideration, the influence by the act of wiping a person having low power of resistance to disease after bathing, while he or she is exposed directly to the atmosphere. More specifically, the clothes of the present invention, for example the bathrobe, may be put on after a sick person, an aged or a baby, who cannot take bath by oneself, took bath with some help, so that the sick person, the aged or the baby may be laid down or seated putting the bathrobe on, until the helper holds the person and put his or her dress on. The clothes of the present invention, for example, the bathrobe may also be used by the helper, that is, after the helper who takes bath with the person who cannot take bath by oneself or a mother of a baby, may put on the clothes of the present invention while he or she wipes and help clothing the sick, the aged or the baby.

The following problem can be solved when the clothes of the present invention such as the bathrobe is put on a baby. Conventionally, a mother or one helps bathing of a baby tends to put too much talcum powder directly on the baby's crotch for drying. This frequently causes an eruption on the skin of the baby, such as a rash at the crotch. Babies suffering from eruption on the skin because the crotch gets musty with the diaper have been frequently observed. If the clothes of the present invention such as the bathrobe is put on the baby after bathing until the baby puts on the regular garment, the above described problem can be solved.

Figure 8:
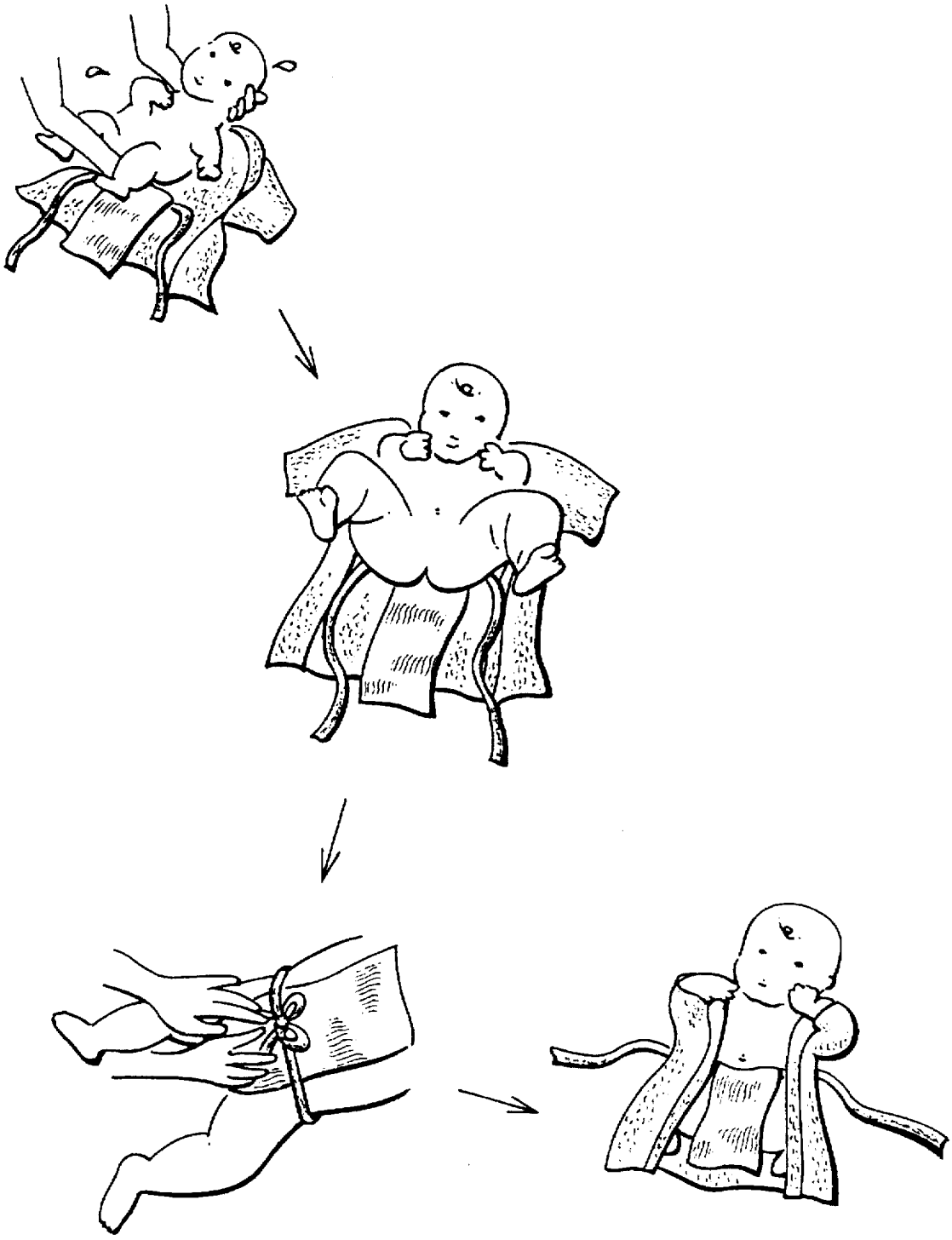
FIG. 8 shows an example of the present invention.

FIG. 8 shows this example. As shown in the figure, a baby after bathing is held and put on the bathrobe of the present invention which has been spread. While the body is still warm, the attached cloth is put on the crotch which is wetty and much susceptible to eruption, and lightly fixed by attached band or the like. Thereafter, the body of the baby is entirely wrapped by the body part of the bathrobe.

In the above described two examples of use, such a situation that the helper after bathing helps the aged or the sick while the helper is still naked after bathing can be avoided when the clothes such as the bathrobe of the present invention is used. Further, when the clothes of the present invention is put on, even a weak, aged person, a sick person or a baby can keep the body warm, and in addition, it can be avoided that the weak or the baby is forcedly put in the garments while he or she is still hot and sweating after bathing in hot weather, for example. Therefore, the person wearing the clothes can keep his or her body warm after bathing until putting on other garments without cooling the body. Therefore, it is possible to keep the weak person comfortable and maintain his or her health condition.

In the above described two examples of use, a person corresponding to the classification (1) and (2) above wears the bathrobe of the present invention. The expected effect of these modes of use is that a chill or fever caused by cooling of the body while the person is still sweaty, or eruption of skin such as a rash caused by the wetty crotch can be prevented, so that the person having lower power of resistance to disease can be protected and good body condition can be kept. Further, the present invention may be used by those classified in (3) after taking shower, taking a bath or after swimming, to help drying the crotch, where he or she has difficulty to reach.

Figure 9:
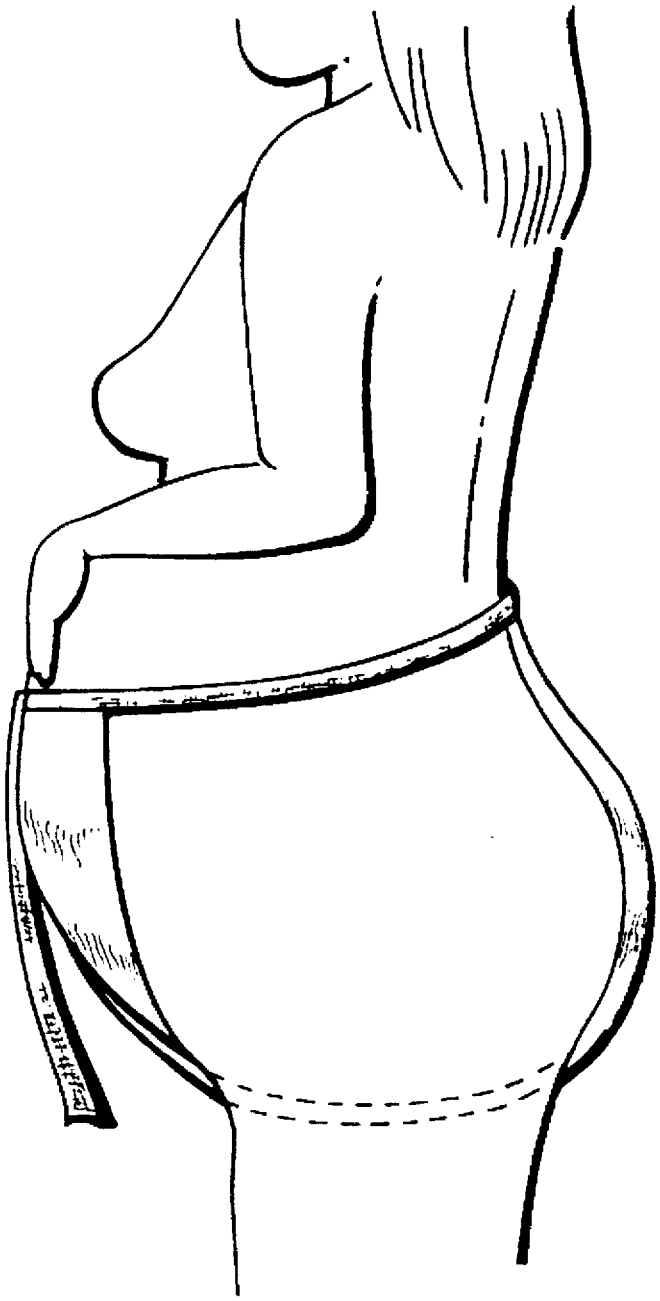
FIG. 9 shows another example of the present invention.

FIG. 9 shows an example in which one who has difficulty to reach his or her crotch wears the clothes of the present invention, focusing only on the attached cloth. As shown in the figure, a pregnant woman puts the attached cloth at her crotch, where she has difficulty to reach, after bathing or the like, and the attached cloth is lightly fixed by attached band or the like. Thus, the water adhered on the crotch can be absorbed by the attached cloth.

Further, when a person classified in (4) above wears the bathrobe of the present invention after swimming or after taking sauna and putting himself or herself at ease, water remaining at the crotch or in the swim suit on the buttocks and abdomen may not cool his or her body, and the person wearing the bathrobe can keep the body warm and comfortable. This can prevent pain in one's abdomen or muscular rigidity caused by cooling.

When a person classified in (5) above wears a kimono robe or a negligee in accordance with the present invention, he or she can keep the crotch dry.

The bathrobe of the present invention may be used by each of family members at home, or the bathrobe may be furnished at a hotel or other accommodation and used shared by many persons. Especially in the latter case, it is preferred in view of practical usefulness that only the body part of the bathrobe is provided and the attached cloth for covering the buttocks is provided separately, attached/detachable with respect to the body part, so that the attached cloth may be put on the body part only when use of that cloth is desired. In that case, the attached cloth may preferably includes the following:

(i) a towel furnished by the hotel or the accommodation which the user may bring back home after use;

(ii) a towel of the user himself or herself brought into the hotel or the accommodation (towels (i) and (ii) are both general, commercially available ones); and (iii) a disposable cloth formed of an unwoven cloth or the like.

As to the cloth (iii), the attached cloth may be a plane single cloth, and it is preferred that processing such as provision of fittings, buttons or the like may be reduced so as to prevent increase in manufacturing cost. When the attached cloth is put on or off by means of a button, the button hole may preferably be provided in the attached cloth. When the attached cloth is to be put on or off by means of a fitting, a concave or female fitting may be provided on the attached cloth.

If the attach cloth for covering one's buttocks is not shared and hence not requiring linen service, it may be more acceptable in view of sanity, and users may be subjected to less physiological resistance. What is required of the hotel or the accommodation facility providing the body of the bathrobe is only the provision and care of the body part, and therefore responsibility with respect to regulations related to sanitary conditions can be relaxed. Therefore, labor and cost in handling the bathrobe of the present invention can be reduced and efficiency in handling the bathrobe can be improved. This leads to increased opportunities of use of the bathrobe in accordance with the present invention.

Embodiments of the bathrobe preferred for such use of the present invention as mentioned above are as follows.

Figure 10:
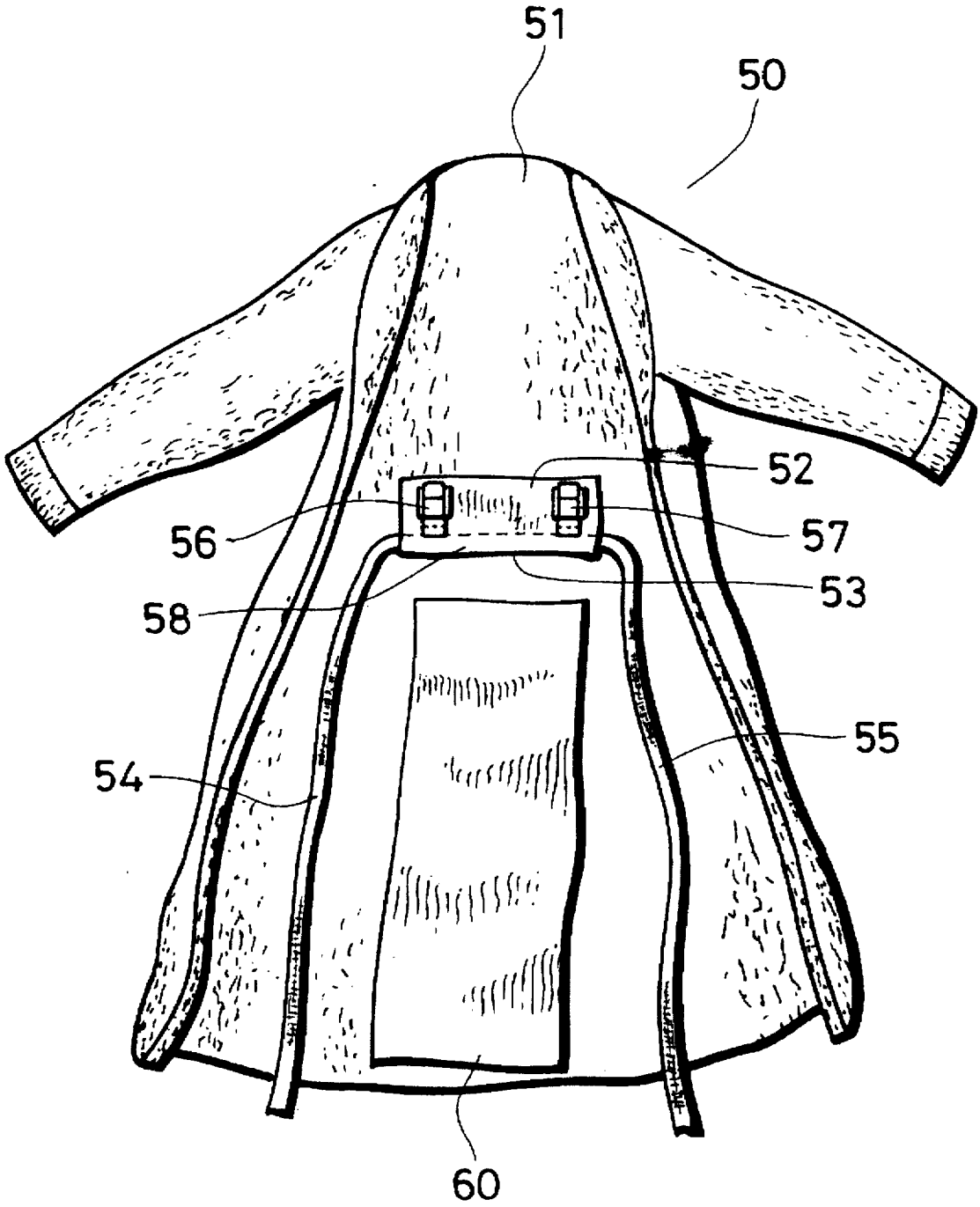
FIGS. 10 and 11 show a fourth embodiment of the bathrobe in accordance with the present invention.
Figure 11:
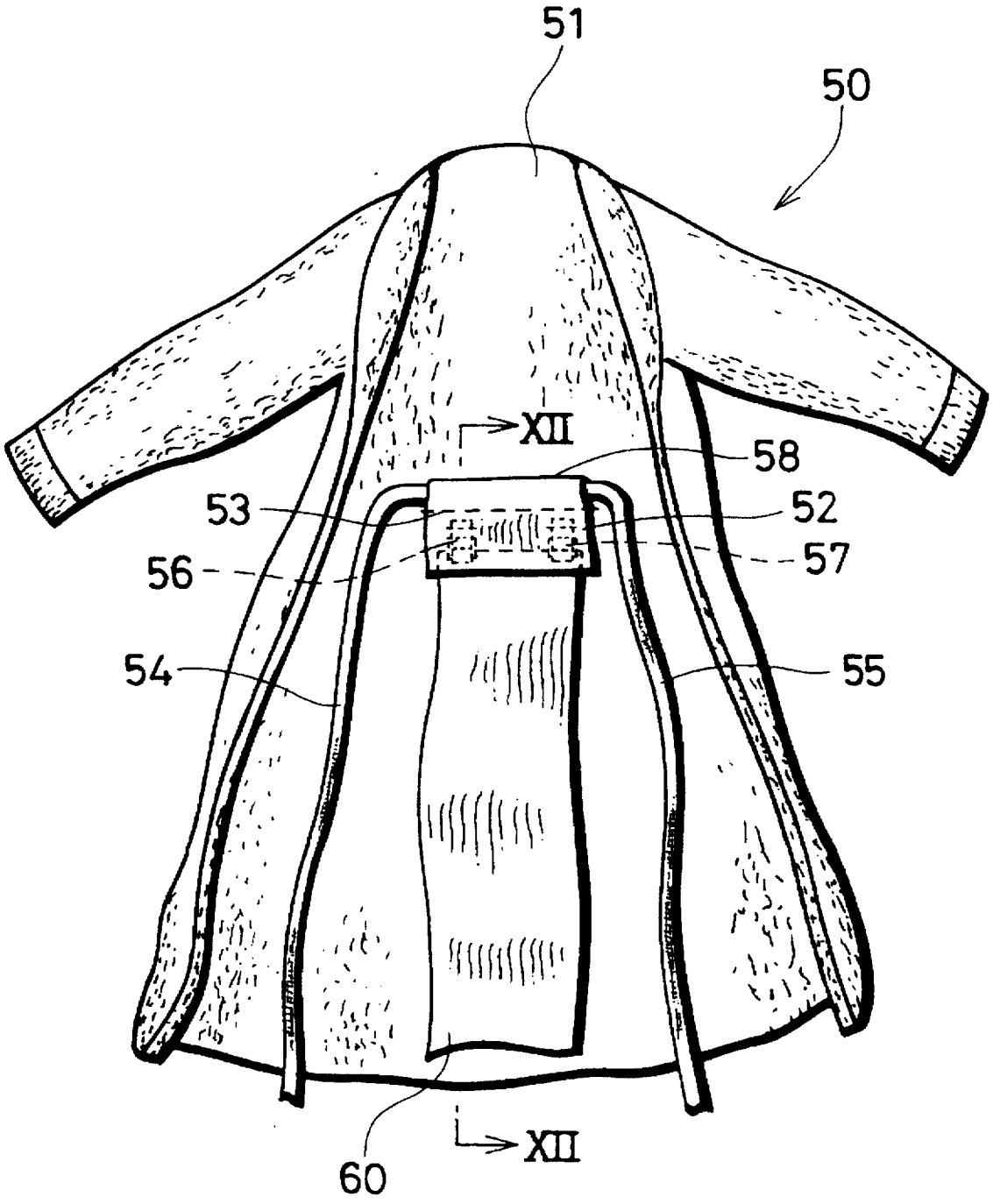

FIGS. 10 and 11 show the fourth embodiment of the bathrobe in accordance with the present invention.

Referring to FIG. 10, this embodiment includes a bathrobe 50 and an attached cloth 60. The bathrobe 50 includes a body part 51 and an adaptor cloth 52. The attached cloth 60 is of a toweling and an individual part separated from the bathrobe 50. For convenience, it is shown placed on the body part 51 of the bath robe 50 in FIG. 10. The adaptor cloth 52 is sewn on the body part 51 at an attaching portion 53. In FIG. 10, the adaptor cloth 52 is shown upside down with respect to the body part 51, at the attaching portion 53. Straps 56 and 57 are sandwiched between adaptor cloth 52 and body part 51 and sewn on both of these. The straps 56 and 57 may be sewn only on the adaptor cloth 52.

Bands 54 and 55 are actually a continuous one band, which is passed through a sheath 58 provided by the adaptor cloth. The band may be sewn on the adaptor cloth 52. Alternatively, the band may be attached to the attached cloth 60.

As shown in FIG. 11, one end of the attached cloth 60 is clipped by straps 56 and 57 and put on the adaptor cloth 52. In this manner, the attached cloth 60 is put on the body part 51 by means of adaptor cloth 52 and straps 56 and 57.

Figure 12:
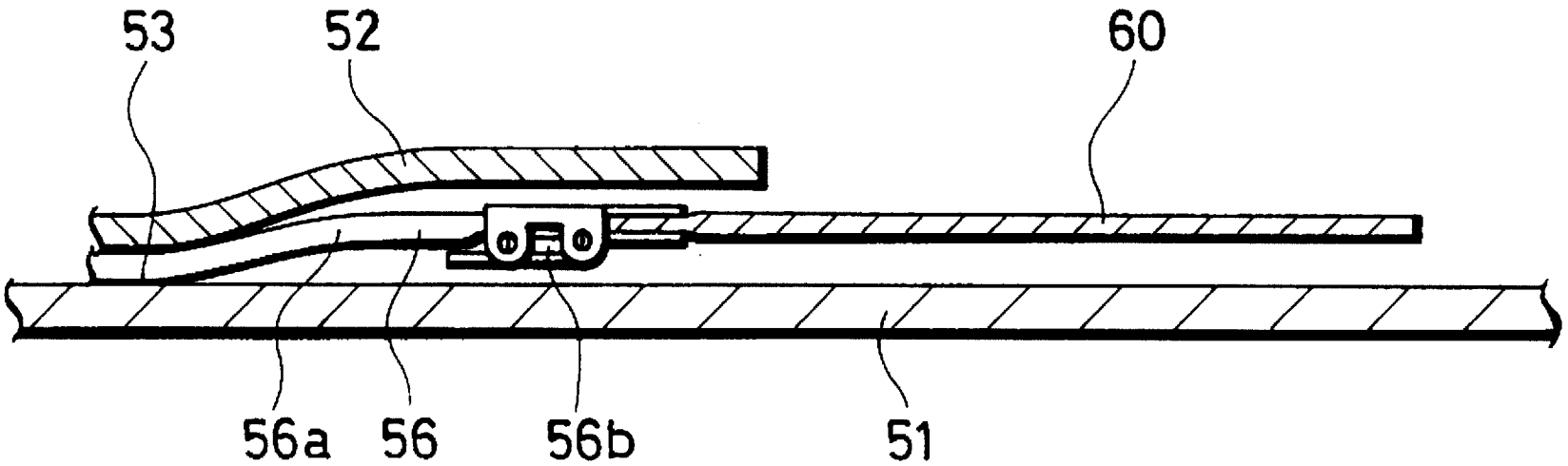
FIG. 12 is a partial cross section taken along the line XII—XII of FIG. 11.

FIG. 12 is a partial cross section taken along the line XII—XII of FIG. 11. Referring to FIG. 12, the attached cloth 60 is clipped by metal portion of the strap 56. The metal portion 56 is covered by the adaptor cloth 52. Therefore, one's body (skin) is in contact with the adaptor cloth 52 but not in direct contact with the metal portion 56. Therefore, there is not such possibility of injury or discomfort caused by the direct contact of one's skin with the metal portion **56*b*. The belt portion 56*a* of the strap 56 is formed of a flexible material, and it is sandwiched between and sewn on attached cloth 52 and body part 51 at the attaching portion 53**.

In this manner, the bathrobe of the present invention allowing use of a general toweling cloth as the attached cloth can be implemented.

Figure 13:
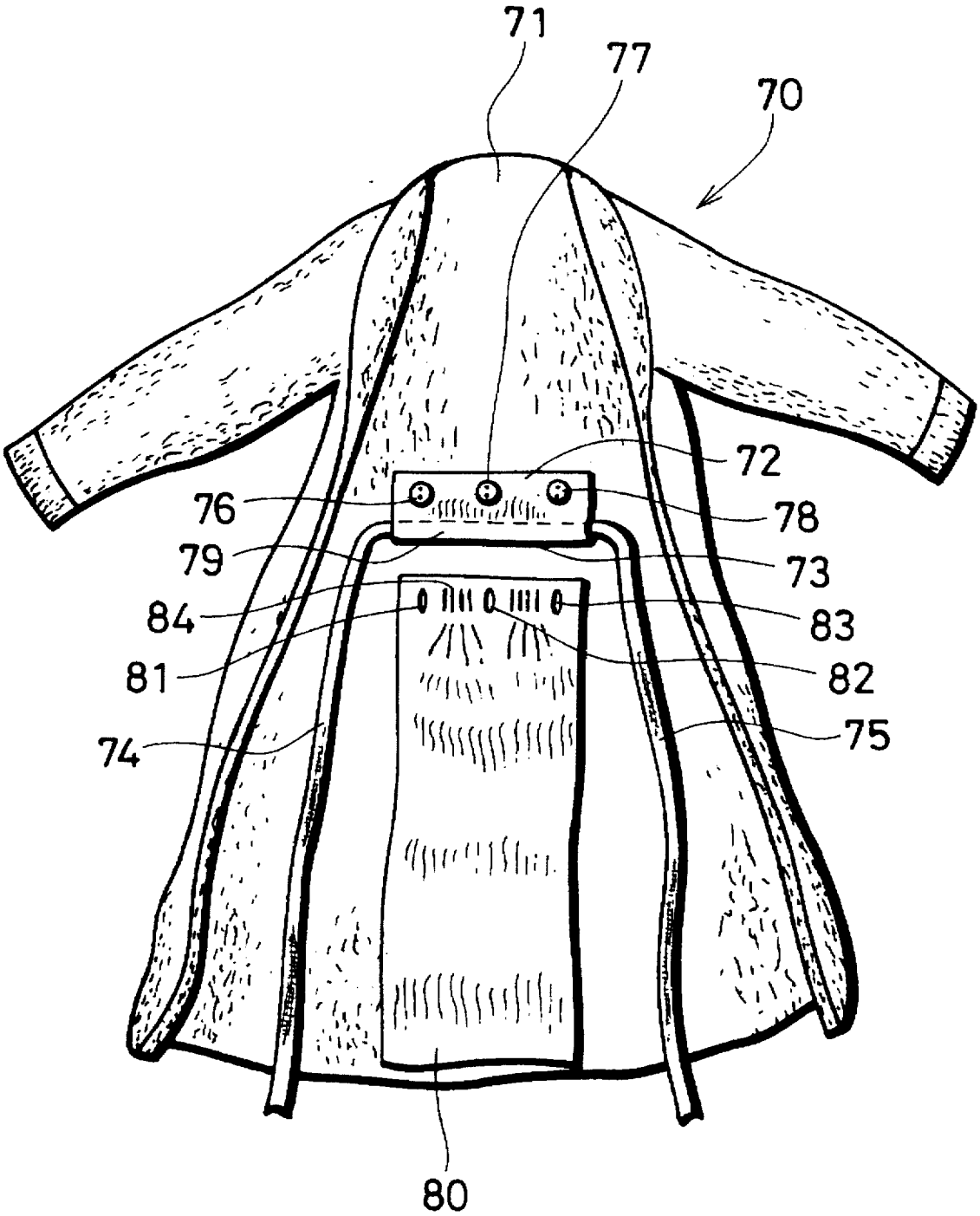
FIGS. 13 and 14 show a fifth embodiment of the bathrobe in accordance with the present invention.
Figure 14:
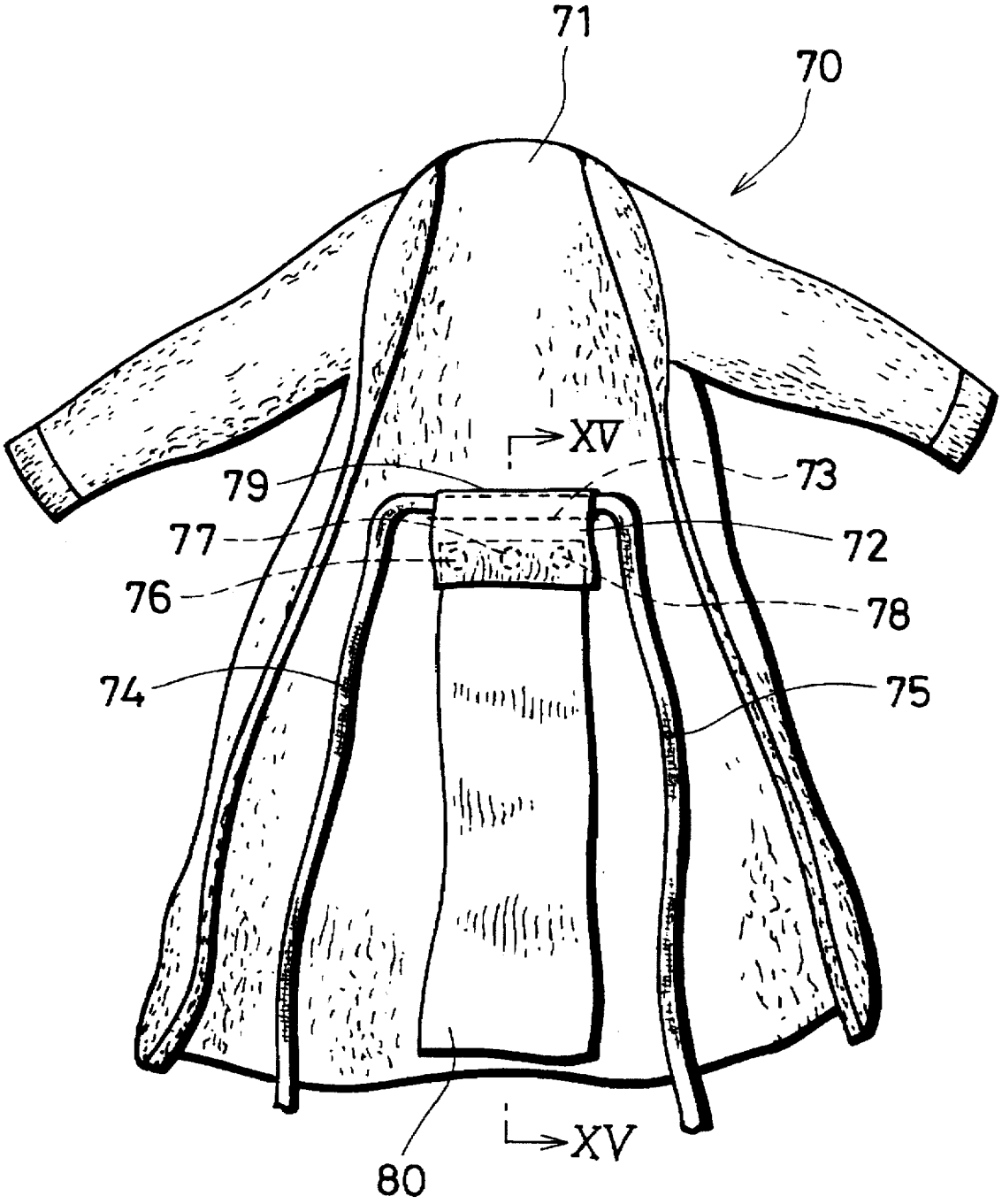

FIGS. 13 and 14 show the fifth embodiment of the bathrobe of the present invention.

Referring to FIG. 13, this embodiment includes a bathrobe 70 and an attached cloth 80. Bathrobe 70 includes a body part 71 and an adaptor cloth 72. The attached cloth 80 is of a toweling and an independent part separate from the bathrobe 70. For convenience, in FIG. 13, it is shown placed on body part 71 of bathrobe 70. On one end of attached cloth 80, button holes 81, 82 and 83 are provided, and said one end is gathered (gather 84).

The adaptor cloth 72 is sewn on body part 71 at an attaching portion 73. FIG. 13 shows the adaptor cloth 72 placed upside down with respect to the body part 71 at attaching portion 73. Buttons 76, 77 and 78 are sewn on the adaptor cloth 72. In this example, buttons may be sewn on one end of the attached cloth 80 and button holes may be opened at adaptor cloth 72. Alternatively, loops engageable with the buttons may be provided at one end of attached cloth 80 and buttons may be sewn on the adaptor cloth 72. In this case also, the loops may be provided on adaptor cloth 72 and buttons may be sewn on one end of the attached cloth 80. Further, a convex shaped fitting, a hook or male VELCRO®, e.g., a conventional hook and loop fastening tape system, may be provided instead of the buttons as the fittings, and concave fitting, hook or female VELCRO®, e.g., a conventional hook and loop fastening tape system may be used instead of the button hole or the loop. In any case, the button or the convex shaped fitting is put on the adaptor cloth 72 or attached cloth 80 facing the body part 71 of the bathrobe 70 at the time of use. This is to prevent the button or the convex fitting from being in direct contact with one's body (skin).

Bands 74 and 75 are actually one continuous band passed through a sheath 79 provided by the adaptor cloth 72.

The band may be sewn on the adaptor cloth 72. Alternatively, the band may be sewn on the attached cloth 80.

Referring to FIG. 14, by engaging buttons 76, 77 and 78 with button holes 81, 82 and 83, one end of the attached cloth 80 is put on the adaptor cloth 72. In this manner, attached cloth 80 is put on body part 71 by means of buttons 81, 82 and 83, button holes 76, 77 and 78 and adaptor cloth 72.

Figure 15:
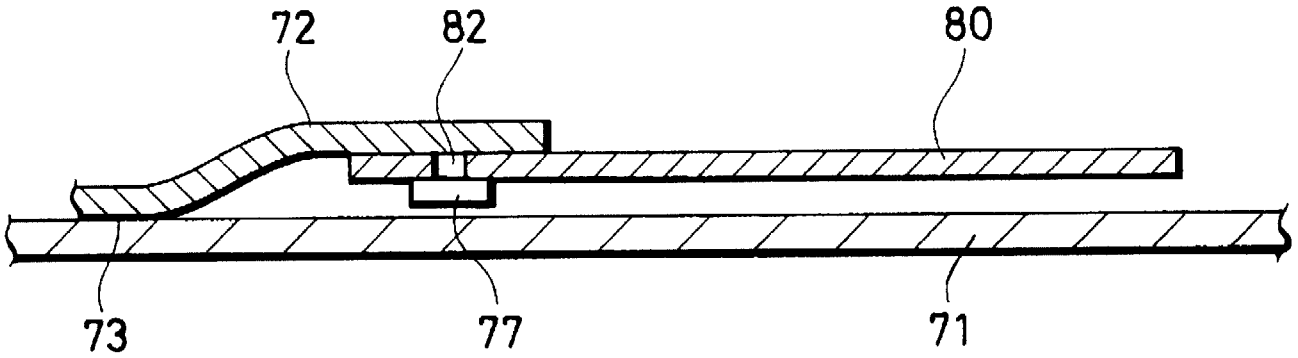
FIG. 15 is a partial cross section taken along the line XV—XV of FIG. 14.

FIG. 15 is a partial cross section taken along the line XV—XV of FIG. 14. As shown in FIG. 15, attached cloth 80 is put on the adaptor cloth 72 by engagement of button 77 and button hole 82. Button 77 is facing the body part 71, and therefore it is not in direct contact with one's body (skin).

Figure 16:
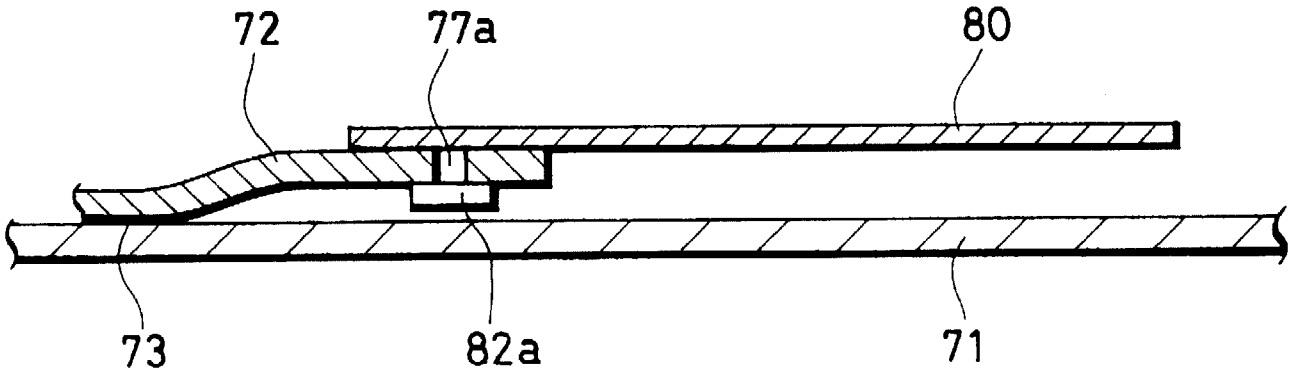
FIG. 16 is a cross section similar to FIG. 15, showing a modification of the present invention.

FIG. 16 is a cross section similar to FIG. 15, which shows an example in which button **82*a* is sewn on attached cloth 80 and button hole 77*a* is opened at adaptor cloth 72. In this case also, button 82*a* faces the body part 71**, and therefore it is not in direct contact with one's body (skin).

Though the present invention has been described with reference to some embodiments above, the embodiments shown are only for the purpose of illustration. Therefore, various modification and changes are possible within the equivalent scope of the present invention. For example, though an attached cloth or covering one's crotch having the shape of a loincloth has been described in the embodiments, it may be changed to have various other shapes, provided that it has a function of covering the crotch.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An article of clothing having sleeves for direct placement on a wet body, said clothing article comprising:

a body part; and a cloth attached to the said body part for wrapping and covering the crotch of the body; wherein:

said attached cloth is detachable from said body part;

said attached cloth comprises a strip shaped cloth, and one end of the cloth is provided with a band;

said band includes an elastic portion; and said band has an intermediate portion and opposing end portions, the intermediate portion including an elastic material, and mutually engageable fittings attached on the opposing end portions.

2. An article of clothing having sleeves for direct placement on a wet body, said clothing article comprising:

a body part; and a cloth attached to the said body part for wrapping and covering the crotch of the body; wherein:

said attached cloth is detachable from said body part;

said attached cloth comprises a strip shaped cloth having a relatively wide end and a relatively narrow end, said relatively wide end being attached to said body part; and an elastic portion is provided along said relatively wide end of the cloth, and mutually engageable fittings are attached to peripheral edge portions of said relatively wide end.

3. The clothing article according to claim 2, wherein said fittings include a button and a button hole.

4. A sleeved bathrobe for direct application on a wet body, said bathrobe comprising:

a body part; and an attached cloth having one end sewn on and extending along the length of said body part a sufficient distance so that it can be wrapped about and cover the crotch of the body; wherein said attached cloth comprises a strip shaped cloth with an elastic portion attached to one end of said attached cloth, and mutually engageable fittings attached at opposing end portions of the elastic portions.

5. A sleeved bathrobe for direct application on a wet body, said bathrobe comprising:

a body part; and a cloth attached to and extending along the length of said body part so that it can be wrapped about and cover the crotch of the body; wherein said attached cloth comprises a relatively wide first portion, and a relatively narrow strip shaped second portion extending from the first portion, an edge portion of said first portion is sewn on said body part, an elastic portion is provided along said first portion, and mutually engageable fittings are attached at peripheral edges of said first portion.

6. An article of clothing having sleeves for direct application on a wet body, said clothing article comprising:

a body part;

a strip shaped attached cloth; and an adaptor cloth sewn on said body part for attachment of said cloth thereto, wherein:

the strip shaped attached cloth extends along the length of said body part so that it can be wrapped about the crotch of the body;

a band is attached to said adaptor cloth; and a strap is sewn on said adaptor cloth for attachment of said cloth thereto.

7. An article of clothing having sleeves for direct application on a wet body, said clothing article comprising:

a body part;

a strip shaped attached cloth; and an adaptor cloth sewn on said body part for attachment of said cloth thereto, wherein:

the strip shaped attached cloth extends along the length of said body part so that it can be wrapped about the crotch of the body;

a band is attached to said adaptor cloth; and one of a button and a button hole is provided on said adaptor cloth, the other one of said button and said button hole is provided on said cloth, and said cloth is attached on said adaptor cloth by means of said button and said button hole.

* * * * *